United States Patent [19]

Ito

[11] Patent Number: 4,711,205

[45] Date of Patent: Dec. 8, 1987

[54] INJECTION START ADVANCER FOR FUEL INJECTION PUMP ASSEMBLY OF THE FUEL DISTRIBUTION TYPE

[75] Inventor: Satoru Ito, Higashimatsuyama, Japan

[73] Assignee: Diesel Kiki Co., Ltd., Tokyo, Japan

[21] Appl. No.: 946,185

[22] Filed: Dec. 22, 1986

[30] Foreign Application Priority Data

Jan. 20, 1986 [JP] Japan ..... 61-5125[U]

[51] Int. Cl.[4] ..... F02M 39/00

[52] U.S. Cl. ..... 123/179 L; 123/502; 123/449

[58] Field of Search ..... 123/179 L, 502, 501, 123/500, 449, 365

[56] References Cited

U.S. PATENT DOCUMENTS

| | | | |
|---|---|---|---|
| 4,177,775 | 12/1977 | Hofer | 123/502 |
| 4,183,342 | 1/1980 | Lohner | 123/501 |
| 4,312,312 | 1/1982 | Hofer | 123/502 |
| 4,359,995 | 11/1982 | Mowbray | 123/501 |
| 4,387,688 | 6/1983 | Eheim | 123/179 L |
| 4,406,268 | 9/1983 | Eheim | 123/179 C |
| 4,501,252 | 2/1985 | Stumpp | 123/502 |
| 4,509,470 | 4/1985 | Ito | 123/449 |
| 4,563,996 | 1/1986 | Konrata | 123/502 |

*Primary Examiner*—Carl Stuart Miller

*Attorney, Agent, or Firm*—Wenderoth, Lind & Ponack

[57] ABSTRACT

A roller holder angularly movably mounted on a drive shaft for controlling timing for axial displacement of a plunger to change fuel injection timing of a fuel injection pump assembly is engaged by a ball pin fixed to a shaft rotatably supported by a pump housing. The roller holder is urged by a first spring-biased lever to move in a direction to advance fuel injection, the first lever being fixed to the shaft. A heat-sensitive material which is contractable and expandable according to ambient temperature is urged by a second spring-biased lever so as to be contracted, the second lever being loosely fitted over the shaft. The second lever serves as or has a stopper for limiting the angular position of the first lever. The roller holder is biased in the fuel injection advancing direction until the first lever engages the second lever. The second lever applies a minimum force required to the heat-sensitive material thereby to make the latter durable and reliable.

3 Claims, 4 Drawing Figures

INJECTION START ADVANCER FOR FUEL INJECTION PUMP ASSEMBLY OF THE FUEL DISTRIBUTION TYPE

BACKGROUND OF THE INVENTION

The present invention relates to an injection start advancer for a fuel injection pump assembly of the fuel distribution type, and more particularly to an injection start advancer for obtaining an injection starting angle related to the temperature at which fuel injection is started, using a heat-sensitive device housing a heat-sensitive material which is contractable and expandable according to ambient temperature.

FIG. 1 of the accompanying drawings illustrates a conventional injection start advancer for use with an internal combustion engine. A shaft 2 extends through a housing 1 of a fuel injection pump assembly, and a lever 3 is fixed to the inner end of the shaft 2 within the housing 1. A ball pin 3A is angularly movably mounted on the tip end of the lever 3. The housing 1 accommodates therein a roller holder 6 supporting rollers 16 for controlling the timing of axial displacement of a plunger 5 rotatable with a driver shaft 4 of the fuel injection pump assembly, the roller holder 6 having a recess 7 in which the ball pin 3A is inserted. Levers 8, 9 are secured to an outer portion of the shaft 2 which extends outside of the housing 1. The lever 8 is coupled to a spring 10 that normally urges the roller holder 6 in a direction to advance fuel injection. A heat-sensitive device 13 comprises a container 12 housing a heat-sensitive material 12A such for example as wax pellets which is contractable and expandable according to ambient temperature and a movable member 12B having one end held against the heat-sensitive material 12A. The other end of the movable member 12B is fixed to one end of a rod member 11 with its other end engaging the distal end of the lever 9. A pipe (not shown) for passing an engine coolant therethrough is wound around the heat-sensitive device 13.

When the temperature of the engine coolant is higher than a preset temperature, the movable member 12B pushes the end of the rod member 11 to cause the lever 9 to turn the shaft 2 clockwise in FIG. 1, thus positioning the ball pin 3A out of engagement with a lower edge of the recess 7.

At the time of starting the engine from a cold condition, the heat-sensitive material 12A is contracted, allowing the shaft 2 to turn counterclockwise under the resiliency of the spring 10 until the movable member 12B is caused by the rod member 11 to abut against the heat-sensitive material 12A. The ball pin 3A now engages the lower edge of the recess 7 to move the roller holder 6 in the fuel injection advancing direction. Thus, an injection starting angle corresponding to the temperature at the time of starting the engine is obtained.

With the aforesaid conventional injection start advancer, however, if the spring 10 were so strong as to be able to advance the fuel injection timing or increase the injection starting angle as the ambient temperature is lowered, then the heat-sensitive material 12A would be subject to a strong force normally tending to compress the same, resulting in a durability problem of the heat-sensitive material 12A. To avoid this drawback, it has been customary to utilize the difference between the frictional force between the rollers 16 and shafts supporting them at the time the fuel injection pump assembly is rotated and the frictional force between the rollers 16 and their shafts at the time the fuel injection pump assembly is stopped, and to set the force of the spring 10 such that the spring 10 cannot turn the roller holder 6 when the pump assembly is at rest, while the spring 10 can turn the roller holder 6 when the pump assembly is rotated. This can reduce the force acting on the heat-sensitive material 12A during operation of the fuel injection pump assembly, with the consequence that the durability of the heat-sensitive material 12A is increased.

With the aforesaid spring force setting, when the engine is at rest, the heat-sensitive material 12A is contracted without being subjected to the force of the spring 10 as the ambient temperaure descreases. In the absence of any pressure on the heat-sensitive material 12A, it has different temperaure-dependent rates of contraction and expansion, resulting in variations in the fuel injection starting angle that is determined by the position of the distal end of the movable member 12B which engages the rod member 11.

SUMMARY OF THE INVENTION

It is an object of the present invention to provide an injection start advancer for use with a fuel injection pump assembly of the fuel distribution type, which is capable of a fuel injection starting angle dependent on ambient temperature even when no pressure is applied to a heat-sensitive material.

To achieve the above object, there is provided an injection start advancer in a fuel injection pump assembly of the distribution type, comprising a pump housing, a drive shaft rotatably supported by the pump housing, a plunger coupled to the drive shaft and rotatable and reciprocable thereby for delivering fuel under pressure, injection timing control means disposed between the drive shaft and the plunger for controlling timing for axial displacement of the plunger, a shaft extending through the pump housing and rotatably supported thereby, engagement means fixed to a portion of the shaft within the pump housing for engaging the injection timing control means, a first lever fixed to a portion of the shaft outside of the pump housing, a first spring acting on the first lever for normally urging the injection timing control means in a direction to advance fuel injection, a second lever loosely fitted over the shaft, a heat-sensitive material contractable and expandable according to ambient temperature, and a second spring acting on the second lever for normally urging the same in a direction to apply a pressure to the heat-sensitive material, the second lever serving as a stopper for limiting an angular position of the first lever.

The heat-sensitive material is subject at all times to a force applied by the second lever biased by the second spring. The injection timing control means is also subject to a force in the fuel injection advancing direction, applied by the first spring through the first lever. While the internal combustion engine associated with the fuel injection pump assembly is at rest, the frictional forces produced between rollers on the fuel injection timing means and shafts supporting these rollers are large, thereby keeping the fuel injection timing control means at an injection advancing angle of 0. When the engine is started, the frictional forces are reduced, and the fuel injection timing control means advances fuel injection until the first lever is caused by the first spring to move into engagement with the second lever. Since the position of the seocnd lever varies with the temperature-dependent expansion or contraction of the heat-sensitive material, the fuel injection advancing angle corresponds to the temperature at which the engine is started. Since the force is always applied to the heat-sensitive material by the second lever, the expansion and contraction thereof are stable for allowing the fuel injection timing control means to provide the fuel injection advancing angle stably.

The above and other objects, features and advantages of the present invention will become more apparent from the following description when taken in conjunction with the accompanying drawings in which a preferred embodiment of the present invention is shown by way of illustrative example.

BRIEF DESCRIPTION OF THE DRAWINGS

FIG. 2(*b*) is a schematic side elevational view of the injection start advancer of FIG. 2(*a*), showing the parts position when the engine is in operation.

DESCRIPTION OF THE PREFERRED EMBODIMENT

Figure 3:
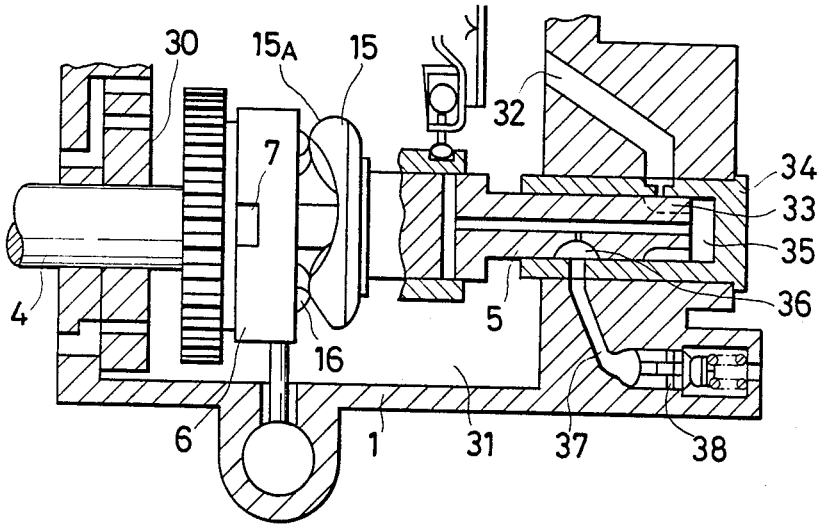
FIG. 3 is a fragmentary longitudinal cross-sectional view of a fuel injection pump assembly of the fuel distribution type combined with the injection start advancer of the present invention.

As shown in FIG. 3, a fuel injection pump assembly of the fuel distribution type for use with an internal combustion engine includes a pump housing 1, a drive shaft 4 rotatably supported in the housing 1 and drivable by an internal combustion engine, and a plunger 5 disposed coaxially and rotatable with the drive shaft 4 thorugh a driving disc (not shown), the plunger 5 being axially displaceable. A cam disc 15 is fixed to one end of the plunger 5 and has a cam surface 15A facing toward the drive shaft 4 and having as many cam lobes as the number of the cylinders of the engine. A roller holder 6 is rotatably mounted on the drive shaft 4 in coaxial relation thereto, with rollers 16 rotatably supported on the roller holder 6. The cam surface 15A is pressed against the rollers 16 under the resiliency of a plunger spring (not shown). Therefore, when the drive shaft 1 is rotated about its own axis, the plunger 5 is rotated thereby about its own axis and is caused by rolling engagement between the cam surface 15A and the rollers 16 to move axially back and forth for drawing, pressurizing, distributing, and pressure-feeding fuel.

More specifically, upon rotation of the drive shaft 4 in synchronism with rotation of the engine output shaft, a feed pump 30 is driven to feed fuel from a fuel tank (not shown) into a suction space 31 defined in the housing 1 and serving as a low-pressure chamber. When the dirve shaft 4 is rotated, the plunger 5 is also rotated and moved back and forth. As the plunger 5 is rotated and moved to the left (FIG. 3), the fuel in the suction space 31 is drawn therefrom through a suction passage 32 defined in the housing 1 and one of suction slots 33 defined in the outer peripheral surface of a head portion of the plunger 5 into a pressurizing chamber 35 defined in a plunger barrel or pump cylinder 34 between the tip end of the plunger 5 and the bottom of the barrel 34. As the plunger 5 is continuously rotated and moved to the right, the suction passage 32 and the suction slot 33 are disconnected from each other, and the fuel drawn into the pressurization chamber 35 is pressurized and fed through one of as many distribution slots 36 communicating with the pressurization chamber 35 as the number of the engine cylinders, a discharge passage 37, and a delivery valve 38 into a fuel injection valve associated with each of the engine cyliniders.

The roller holder 6 is coaxially and rotatably mounted on the drive shaft 4 such that the timing for axial displacement of the plunger 5 can be varied by the angular position of the roller holder 6 for controlling the angle of starting fuel injection.

Figure 1:
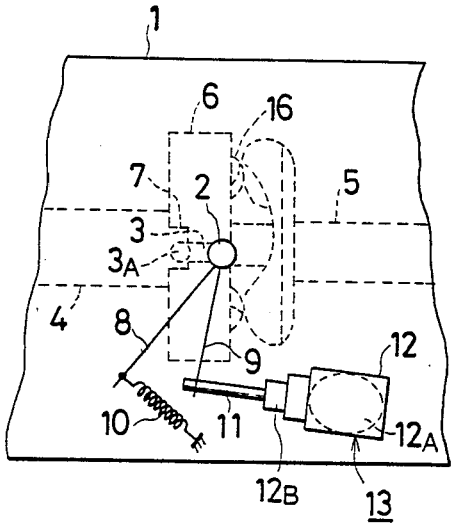
FIG. 1 (PRIOR ART)
FIG. 1 is a schematic side elevational view of a conventional injection start advancer combined with a fuel injection pump assembly.
Figure 2A:
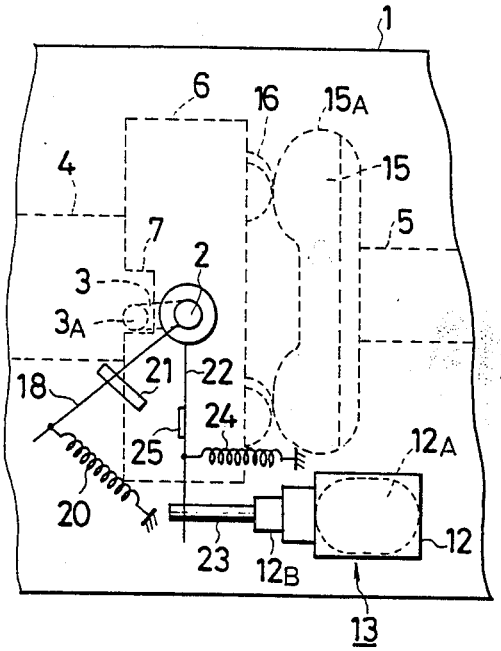
FIG. 2(*a*) is a schematic side elevational view of an injection start advancer according to the present invention, the view showing the position of the parts when an internal combustion engine associated with the injection start advancer is at rest.
Figure 2B:
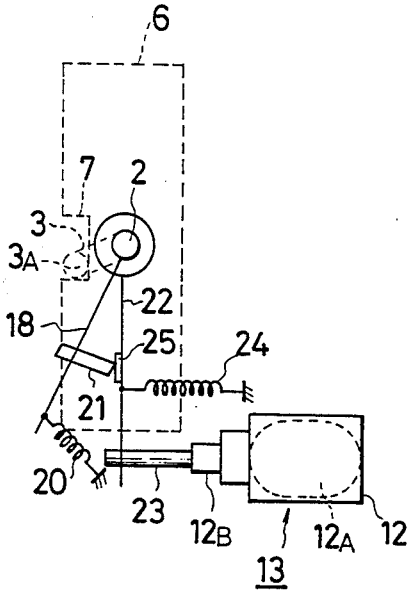

As shown in FIG. 2(*a*), a shaft 2 extends through the housing 1, and a lever 3 is fixed to the inner end of the shaft 2 within the housing 1. A ball pin 3A is angularly movably mounted on the tip end of the lever 3 and is inserted in a recess 7 defined in the roller holder 6. A lever 18 is secured to an outer portion of the shaft 2 which extends outside of the housing 1, with a rod member 21 supported on the lever 18. The lever 18 is coupled to a rod member 21 and a spring 20 that normally urges the roller holder 6 in a direction to advance fuel injection. Another lever 22 is loosely fitted over the outer portion of the shaft 2. The lever 22 serves as a stopper for limiting the angular position of the lever 18, or may have a separate stopper 25 supported thereon for limiting the angular position of the lever 18. A heat-sensitive device 13 comprises a container 12 housing a heat-sensitive material 12A such for example as wax pellets which is contractable and expandable according to ambient temperature and a movable member 12B having one end held against the heat-sensitive material 12A. The other end of the movable member 12B is fixed to one end of a rod member 23 with its other end engaging the distal end of the lever 22. A pipe (not shown) for passing an engine coolant therethrough is wound around the heat-sensitive device 13. The lever 22 is coupled to a spring 24 that normally urges the rod member 23 toward the movable member 12B of the heat-sensitive device 13.

The lever 18 is biased by the spring 20 to cause the ball pin 3A to force the roller holder 6 in the fuel injection advancing direction. The heat-sensitive material 12A is subject to a stable force from the spring 24 through the rod member 23 and the movable member 12B. Therefore, the distal end of the movable member 12B which is secured to the rod member 23 is always controlled at a position dependent on ambient temperature around the heat-sensitive device 13.

When the engine is started under a cold condition, the lever 18 undergoes a large frictional force produced between the rollers 16 and shafts supporting the same, and is positioned at an injection starting angle of 0 as shown in FIG. 2(*a*). When the frictional force is lowered after starting of the engine, the resilient force of the spring 20 overcomes that frictional force, causing the lever 18 to turn counterclockwise from the position of FIG. 2(*a*) to the position of FIG. 2(*b*) to move the roller holder 6 in the fuel injection advancing direction. The counterclockwise movement of the lever 18 causes the rod member 21 to engage the stopper 25 on the lever 22, whereupon the movement of the roller holder 6 in the fuel injection advancing direction ceases.

As described above, since the heat-sensitive material 12A is subject to the force of the spring 24 at all times, the position of the distal end of the movable member 12B corresponding to the ambient temperature, with the result that a fuel injection starting angle dependent on the ambient temperature can be obtained stably at all times.

With the arrangement of the present invention, the spring 20 for driving an injection timing control means in the fuel injection advancing direction, and the spring 24 for biasing the heat-sensitive material 12A at all times are separate from each other. The spring 20 only needs to apply a minimum force to the injection timing control means to rotate the same during rotation of the engine. The spring 24 only needs to produce a force required to allow the heat-sensitive material to contract and expand stably dependent on the ambient temperature. Consequently, the force applied to the heat-sensitive material while the engine is in operation may be of a minimum value required, and the heat-sensitive material remains durable and highly reliable.

The heat-sensitive material undergoes a stable force even when the engine is at rest, with the result that a fuel injection starting angle can be obtained stably at all times which corresponds to the ambient temperature.

Although a certain preferred embodiment has been shown and described, it should be understood that many changes and modifications may be made therein without departing from the scope of the appended claims.

What is claimed is:

1. An injection start advancer in a fuel injection pump assembly of the distribution type, comprising:

a pump housing;

a drive shaft rotatably supported by said pump housing;

a plunger coupled to said drive shaft and rotatable and reciprocable thereby for delivering fuel under pressure;

injection timing control means disposed between said drive shaft and said plunger for controlling timing for axial displacement of said plunger;

a shaft extending through said pump housing and rotatably supported thereby;

engagement means fixed to a portion of said shaft within said pump housing for engaging said injection timing control means;

a first lever fixed to a portion of said shaft outside of said pump housing;

a first spring acting on said first lever for normally urging said injection timing control means in a direction to advance fuel injection;

a second lever loosely fitted over said shaft;

a heat-sensitive material contractable and expandable according to ambient temperature; and a second spring acting on said second lever for normally urging the same in a direction to apply a pressure to said heat-sensitive material, said second lever serving as a stopper for limiting an angular position of said first lever.

2. An injection start advancer according to claim 1, further including a separate stopper supported on said second lever for limiting an angular position of said first lever.

3. An injection start advancer according to claim 1, wherein said heat-sensitive material comprises wax pellets.

* * * * *